US011187038B2

(12) United States Patent
Textor et al.

(10) Patent No.: US 11,187,038 B2
(45) Date of Patent: Nov. 30, 2021

(54) LADDER FOOT SUPPORT APPARATUS

(71) Applicants: David Textor, Sherwood, AR (US); Jennifer Textor, Sherwood, AR (US)

(72) Inventors: David Textor, Sherwood, AR (US); Jennifer Textor, Sherwood, AR (US)

( * ) Notice: Subject to any disclaimer, the term of this patent is extended or adjusted under 35 U.S.C. 154(b) by 261 days.

(21) Appl. No.: 16/660,364

(22) Filed: Oct. 22, 2019

(65) Prior Publication Data

US 2021/0115733 A1 Apr. 22, 2021

(51) Int. Cl.
*E06C 7/16* (2006.01)

(52) U.S. Cl.
CPC ..... *E06C 7/165* (2013.01)

(58) Field of Classification Search
CPC . E06C 7/14; E06C 7/084; E06C 7/082; E06C 7/165
See application file for complete search history.

(56) References Cited

U.S. PATENT DOCUMENTS 1,714,028 A * 5/1929 Knuth ..... E06C 1/38 182/120
1,820,315 A * 8/1931 Miller ..... E06C 7/165 182/122
2,090,331 A * 8/1937 Kutscheid ..... E06C 1/393 182/175
2,488,633 A * 11/1949 Linder ..... E06C 7/165 182/120
2,557,270 A * 6/1951 Franklin, Sr. ..... E06C 7/165 182/120
2,730,412 A * 1/1956 Yoder ..... E06C 1/38 182/120
2,899,011 A * 8/1959 Babits ..... E06C 7/165 182/228.3
2,948,349 A 8/1960 Reddy
3,005,513 A * 10/1961 Larson ..... E06C 7/46 182/165
3,078,950 A * 2/1963 Schramm ..... E06C 7/165 182/120
3,111,193 A * 11/1963 McKinnie ..... E06C 7/14 182/22
3,112,811 A * 12/1963 Moran ..... E06C 7/08 182/120
3,115,214 A * 12/1963 Roberts ..... E06C 7/165 182/228.3
3,782,498 A * 1/1974 Gleisen ..... E04G 1/152 182/119
4,080,713 A * 3/1978 Reid ..... B21D 39/00 29/469.5
4,204,587 A * 5/1980 Larson ..... E06C 1/20 182/126

(Continued)

*Primary Examiner* — Colleen M Chavchavadze

(57) ABSTRACT

A ladder foot support apparatus for creating a larger area to support a user's feet includes a base having a base outer side with a pair of parallel slots extending from a base top side through a base bottom side. The pair of slots is configured to receive a rail of a ladder. An upper face of a platform is coupled to the base bottom side and perpendicularly extends away from a base inner side. A lip is coupled to the platform and has a perpendicular portion extending down from a back edge and a return portion curving back up towards a lower face of the platform. The return portion is configured to selectively receive a rung bottom edge of a rung of the ladder.

9 Claims, 4 Drawing Sheets

(56) References Cited

U.S. PATENT DOCUMENTS

| | | | | | |
|---|---|---|---|---|---|
| 4,533,018 | A | | 8/1985 | Tyson | |
| 4,687,075 | A | | 8/1987 | Skaggs | |
| 5,056,620 | A | | 10/1991 | Zumwalt | |
| 5,072,808 | A | * | 12/1991 | Spalt | E06C 7/16 182/103 |
| 5,779,208 | A | | 7/1998 | McGraw | |
| 5,975,240 | A | | 11/1999 | O'Brien | |
| 6,786,300 | B1 | | 9/2004 | Bonifacini | |
| 8,201,661 | B1 | * | 6/2012 | O'Connell, Sr. | E06C 7/16 182/122 |
| 8,631,904 | B1 | * | 1/2014 | Wilds | E06C 7/16 182/116 |
| D717,969 | S | | 11/2014 | Green | |
| 10,006,248 | B2 | * | 6/2018 | Goodnow | E06C 7/165 |
| 10,352,098 | B2 | * | 7/2019 | Frensley | E06C 7/165 |
| 10,358,832 | B1 | * | 7/2019 | Wagner | E06C 7/165 |

* cited by examiner

LADDER FOOT SUPPORT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ladder accessory devices and more particularly pertains to a new ladder accessory device for creating a larger area to support a user's feet.

(2) Description of Related Art Including Information Disclosed Under 37 CFR 1.97 and 1.98

The prior art relates to ladder accessory devices.

BRIEF SUMMARY OF THE INVENTION

An embodiment of the disclosure meets the needs presented above by generally comprising a base having a base top side, a base bottom side, a base front side, a base back side, a base inner side, and a base outer side. The base outer side has a pair of parallel slots extending from the base top side through the base bottom side. The pair of slots is configured to receive a rail of a ladder. A platform is coupled to the base and has an upper face, a lower face, a front edge, a back edge, an inner edge, and an outer edge. The upper face of the platform is coupled to the base bottom side and perpendicularly extends away from the base inner side. A lip is coupled to the platform and has a perpendicular portion extending down from the back edge and a return portion curving back up towards the lower face of the platform. The return portion is configured to selectively receive a rung bottom edge of a rung of the ladder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
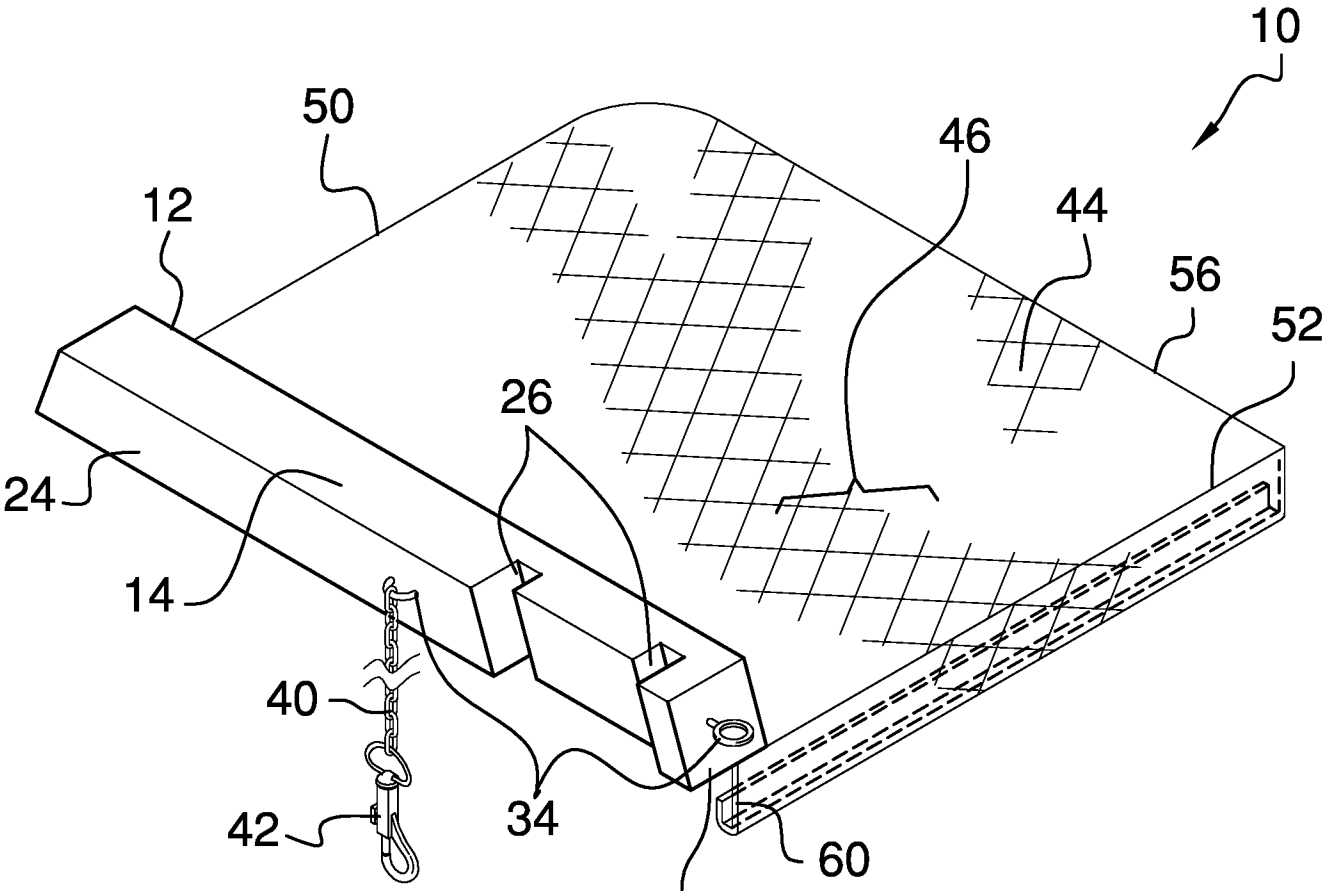
FIG. 1 is an isometric view of a ladder foot support apparatus according to an embodiment of the disclosure.
Figure 2:
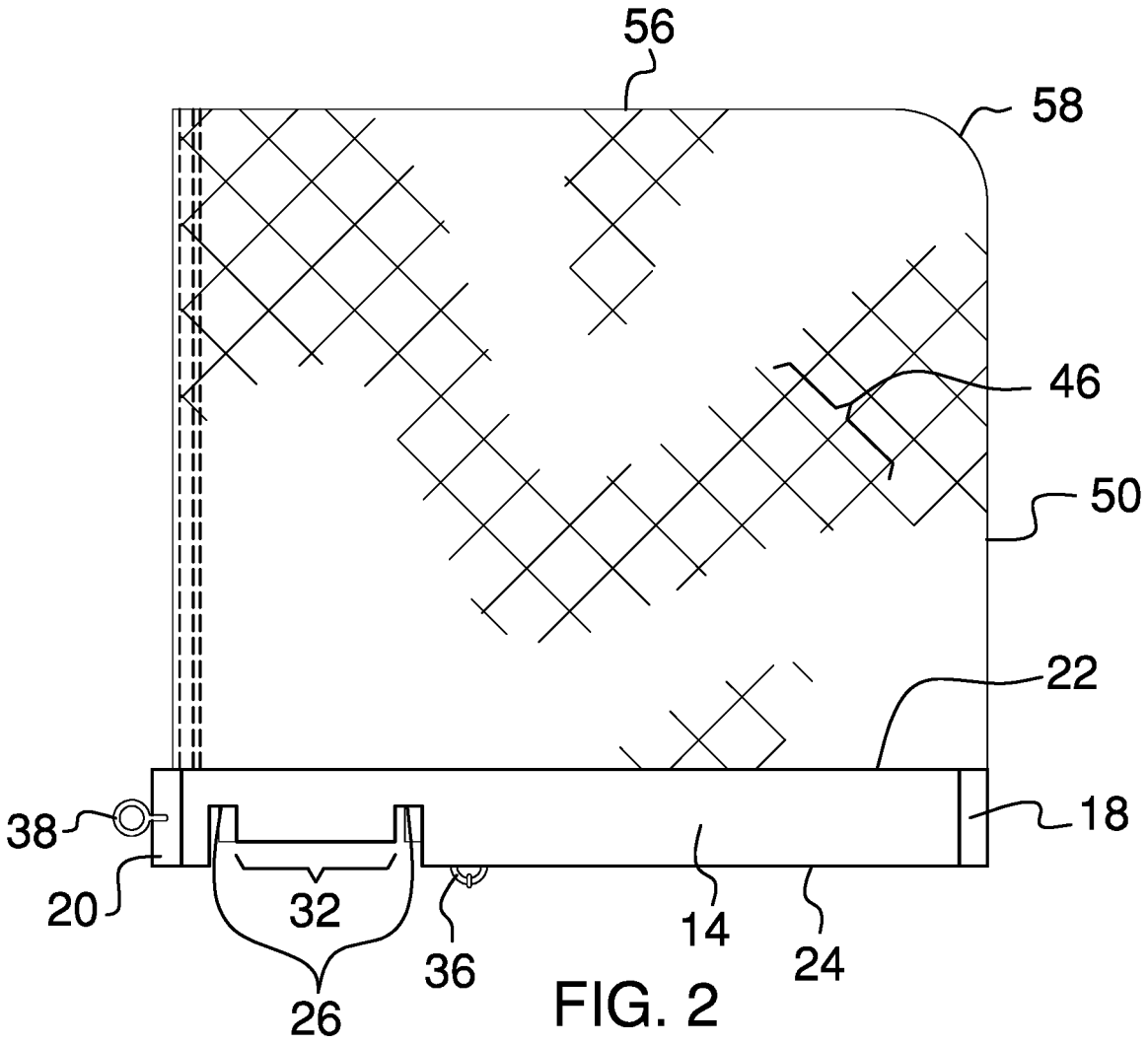
FIG. 2 is a top plan view of an embodiment of the disclosure.
Figure 3:
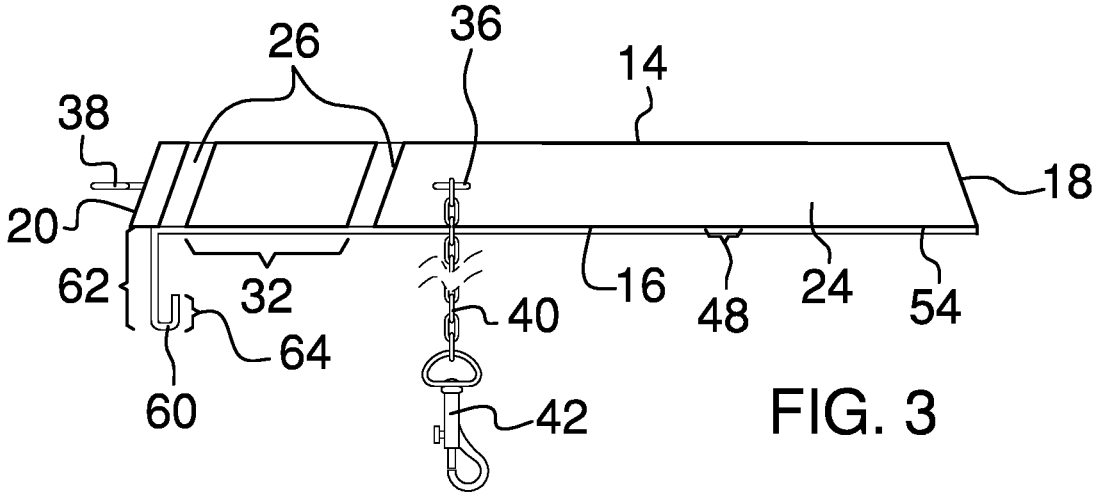
FIG. 3 is a side elevation view of an embodiment of the disclosure.
Figure 4:
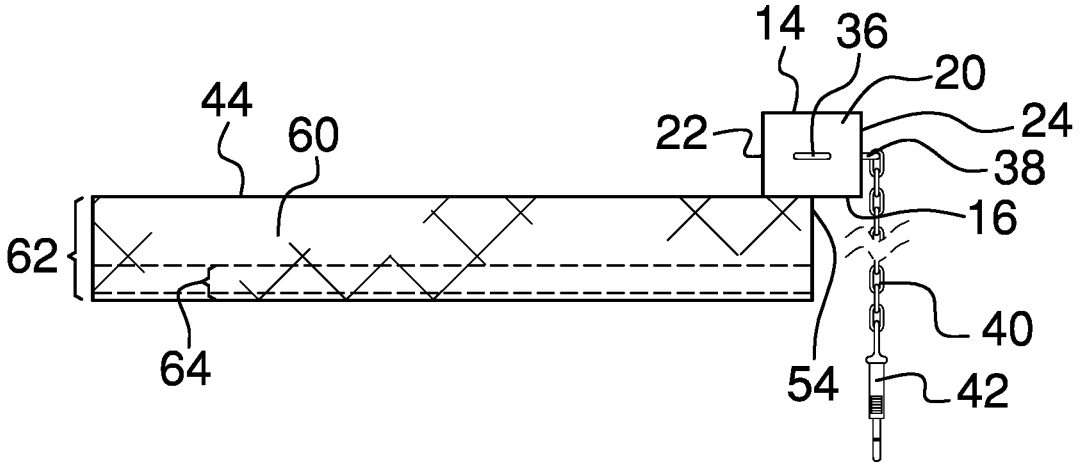
FIG. 4 is a front elevation view of an embodiment of the disclosure.
Figure 5:
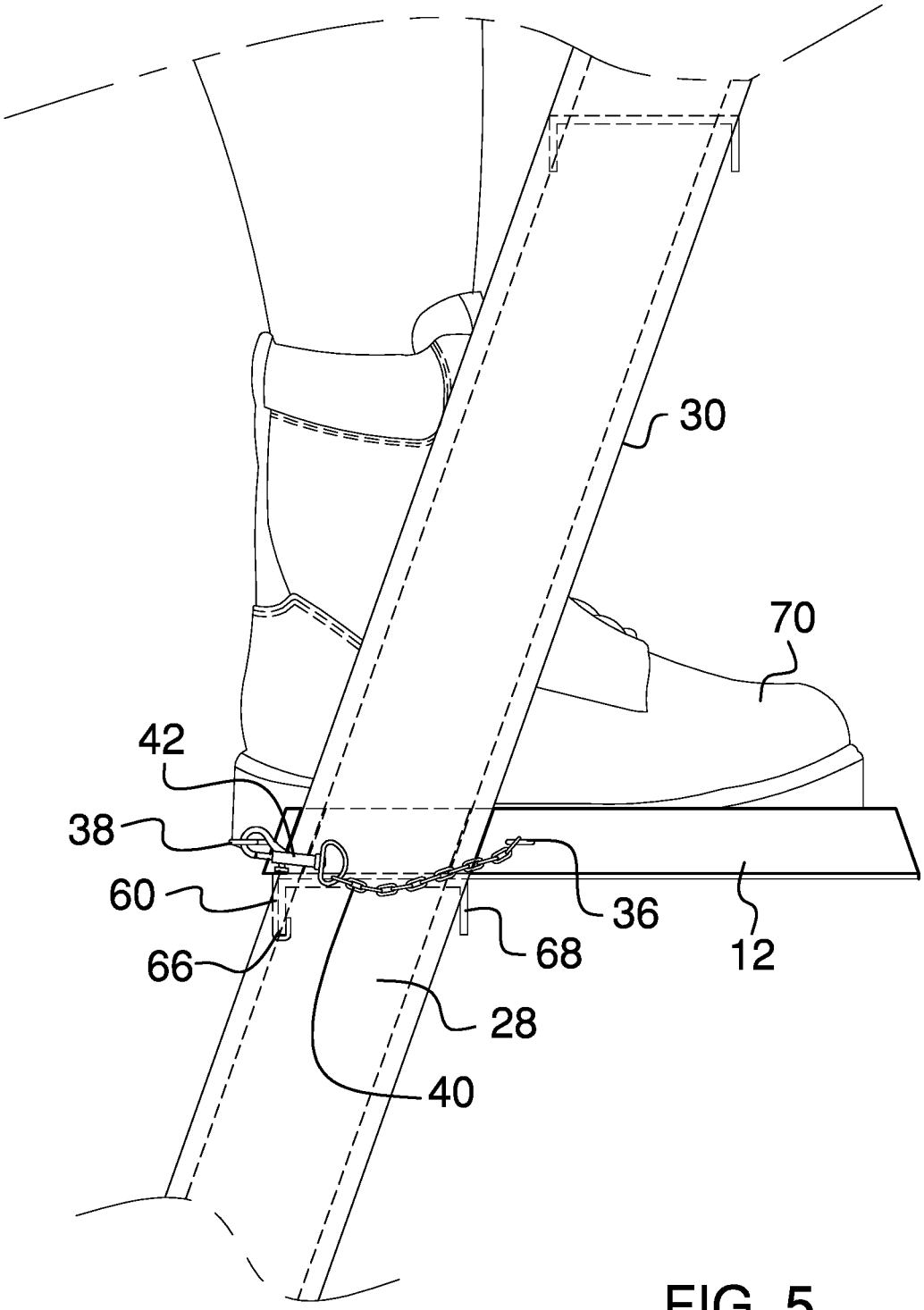
FIG. 5 is an in-use view of an embodiment of the disclosure.

With reference now to the drawings, and in particular to FIGS. 1 through 5 thereof, a new ladder accessory device embodying the principles and concepts of an embodiment of the disclosure and generally designated by the reference numeral 10 will be described.

As best illustrated in FIGS. 1 through 5, the ladder foot support apparatus 10 generally comprises a base 12 having a base top side 14, a base bottom side 16, a base front side 18, a base back side 20, a base inner side 22, and a base outer side 24. Each of the base front side 18 and the base back side 20 may be slanted such that the base inner side 22 and the base outer side 24 are trapezoidal. The base outer side 24 has a pair of parallel slots 26 extending from the base top side 14 through the base bottom side 16. Each of the pair of slots 26 may form an angle less than 90° with the base bottom side 16. The pair of slots 26 is configured to receive a rail 28 of a ladder 30 and the angle allows the base 12 to rest horizontally and compensate for an angle of the ladder 30. The pair of slots 26 defines a medial portion 32 of the base outer side therebetween. The medial portion 32 may lie in a plane more proximal the base inner side 22 to accommodate the thickness of the rail 28 of the ladder.

A pair of rings 34 is coupled to the base 12. The pair of rings 34 comprises a first ring 36 coupled to the base outer side 24 and a second ring 38 coupled to the base back side 20. The first ring 36 may be semi-circular and the second ring 38 may be an eyelet. A chain 40 is coupled to the first ring 36 and has a clip 42 to selectively engage the second ring 38. The chain 40 is configured to wrap around the rail 28 of the ladder to secure the base 12 in place.

A platform 44 is coupled to the base 12. The platform 44 has an upper face 46, a lower face 48, a front edge 50, a back edge 52, an inner edge 54, and an outer edge 56. The upper face 46 of the platform is coupled to the base bottom side 16 and perpendicularly extends away from the base inner side 22. The front edge 50 may align with base front side 18. A distal corner 58 of the platform between the front edge 50 and the outer edge 56 may be rounded to prevent injury. The platform 44 may be mesh to reduce weight, improve grip, and prevent liquid from pooling. A lip 60 is coupled to the platform 44. The lip 60 has a perpendicular portion 62 extending down from the back edge 52 and a return portion 64 curving back up towards the lower face 48 of the platform. The return portion 64 may be U-shaped and is configured to selectively receive a rung bottom edge 66 of a rung 68 of the ladder to secure the apparatus 10 in place.

In use, the return portion 64 is hooked onto the rung bottom edge 66 with the platform 44 resting on the rung 68. The rail 28 is slid into the pair of slots 26 and the chain 40 is wrapped around the rail 28 with the clip 42 engaged with the second ring 38. The platform 44 may then be stood on to create a large, safe, and comfortable area for a user's foot 70.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A ladder foot support apparatus comprising:

a base, the base having a base top side, a base bottom side, a base front side, a base back side, a base inner side, and a base outer side, the base outer side having a pair of parallel slots extending from the base top side through the base bottom side, the pair of slots being configured to receive a rail of a ladder;

a platform coupled to the base, the platform having an upper face, a lower face, a front edge, a back edge, an inner edge, and an outer edge, the upper face of the platform being coupled to the base bottom side and perpendicularly extending away from the base inner side; and a lip coupled to the platform, the lip having a perpendicular portion extending down from the back edge and a return portion curving back up towards the lower face of the platform, the return portion being configured to selectively receive a rung bottom edge of a rung of the ladder.

2. The ladder foot support apparatus of claim 1 further comprising a pair of rings coupled to the base, the pair of rings comprising a first ring coupled to the base outer side and a second ring coupled to the base back side; a chain being coupled to the first ring and having a clip, the clip being selectively engageable with the second ring, the chain being configured to wrap around the rail of the ladder.

3. The ladder foot support apparatus of claim 1 further comprising each of the base front side and the base back side being slanted such that the base inner side and the base outer side are trapezoidal.

4. The ladder foot support apparatus of claim 1 further comprising each of the pair of slots forming an angle less than 90° with the base bottom side.

5. The ladder foot support apparatus of claim 1 further comprising the front edge aligning with base front side.

6. The ladder foot support apparatus of claim 1 further comprising the pair of slots defining a medial portion of the base outer side therebetween, the medial portion lying in a plane more proximal the base inner side.

7. The ladder foot support apparatus of claim 1 further comprising the platform being mesh.

8. The ladder foot support apparatus of claim 1 further comprising a distal corner of the platform between the front edge and the outer edge being rounded.

9. A ladder foot support apparatus comprising:

a base, the base having a base top side, a base bottom side, a base front side, a base back side, a base inner side, and a base outer side, each of the base front side and the base back side being slanted such that the base inner side and the base outer side are trapezoidal, the base outer side having a pair of parallel slots extending from the base top side through the base bottom side, each of the pair of slots forming an angle less than 90° with the base bottom side, the pair of slots being configured to receive a rail of a ladder, the pair of slots defining a medial portion of the base outer side therebetween, the medial portion lying in a plane more proximal the base inner side;

a pair of rings coupled to the base, the pair of rings comprising a first ring coupled to the base outer side and a second ring coupled to the base back side;

a chain coupled to the pair of rings, the chain being coupled to the first ring and having a clip, the clip being selectively engageable with the second ring, the chain being configured to wrap around the rail of the ladder;

a platform coupled to the base, the platform having an upper face, a lower face, a front edge, a back edge, an inner edge, and an outer edge, the upper face of the platform being coupled to the base bottom side and perpendicularly extending away from the base inner side, the front edge aligning with base front side, a distal corner of the platform between the front edge and the outer edge being rounded, the platform being mesh; and a lip coupled to the platform, the lip having a perpendicular portion extending down from the back edge and a return portion curving back up towards the lower face of the platform, the return portion being configured to selectively receive a rung bottom edge of a rung of the ladder.

* * * * *